United States Patent [19]

Swanson

[11] 4,153,893

[45] May 8, 1979

[54] END FITTING FOR HIGH-VOLTAGE FUSE

[75] Inventor: Roy T. Swanson, North Riverside, Ill.

[73] Assignee: S&C Electric Company, Chicago, Ill.

[21] Appl. No.: 837,245

[22] Filed: Sep. 27, 1977

[51] Int. Cl.[2] ..... H01H 85/02

[52] U.S. Cl. ..... 337/201; 337/244; 337/248

[58] Field of Search ..... 337/201, 203, 206, 244, 337/248, 249, 250, 273

[56] References Cited

U.S. PATENT DOCUMENTS

| | | | |
|---|---|---|---|
| 3,183,327 | 5/1965 | Kozacka | 337/244 X |
| 3,304,388 | 2/1967 | Lindell | 337/241 X |
| 3,483,502 | 12/1969 | Mikulecky | 337/244 |
| 3,832,665 | 8/1974 | Belcher | 337/244 |

*Primary Examiner*—George Harris
*Attorney, Agent, or Firm*—John D. Kaufmann

[57] ABSTRACT

An improved end fitting for a high-voltage fuse is disclosed. The fuse is of the general type having a movable striker pin which resides in a first position as long as a fusible element of the fuse remains intact. Should the fusible element cease to be intact, through fusing thereof or mishandling of the fuse, the striker pin moves to a second position to partially exit beyond an end of the fuse when a sharp end of the striker pin pierces a seal at the fuse end. The improved end fitting is removably mountable to the fuse and includes a body having a bore therethrough. The first end of the body surrounds and encloses the seal. A rod, mounted for movement in the bore at the end of the body, resides in a first normal location when the striker pin is in the first normal position, and in a second location when the striker pin is in the second position. Facilities which indicate that the rod is in the second location may include a vividly colored portion of the rod which is visible only when the rod is in the second location. The end fitting is so designed that it prevents the escape from the second end of the body of gas vented from the pierced seal. The end fitting, however, does permit the escape of such gas from the first body end in such a diffuse manner as to greatly reduce the possibility of flashover between adjacent energized live parts. The end fitting also limits the movement of the rod and retains it within the bore at the second location. This has the result of limiting the movement of the striker pin beyond the seal to retain it partially within the bore and partially within the fuse.

23 Claims, 3 Drawing Figures

END FITTING FOR HIGH-VOLTAGE FUSE

BACKGROUND OF THE INVENTION

1. Field of the Invention

This invention relates to an end fitting for a circuit-interrupting device, such as a fuse, and more specifically, to an improved end fitting for a high-voltage fuse.

2. Brief Description of the Prior Art

As a class, high-voltage fuses generally comprise an insulative housing containing a fusible element. The fusible element is attached at one end to a metallic ferrule attached to the housing, and at the other end, to a movable arcing rod or arcing contact which is held in a normal first position and restrained from moving by the fusible element. The arcing rod is in turn electrically connected by sliding contacts, cables, or the like, to a ferrule on the other end of the housing. Springs or the like are often contained within the housing for biasing the arcing rod for movement away from the fusible element. The fuse is connected into a high-voltage circuit by way of appropriate fuse mountings which mechanically and electrically connect to the ferrules. Should an over-current condition in the circuit occur, the fusible element fuses or melts, thus permitting the spring to move the arcing rod away from its normal position. Such movement stretches or elongates the resulting high-voltage arc, which occurs where the element melts, and causes that arc to interact with an arc-extinguishing medium through which the arcing rod moves. This interaction causes the evolution of deionizing, cooling and swirling gases by the arc-extinguishing material to ultimately extinguish the arc. The arcing rod then comes to rest at a second remote location.

Two specific types of the above generally-described high-voltage fuse are so-called non-dropout fuses and dropout fuses. In a non-dropout fuse, the above action occurs following an over-current condition but the fuse remains stationary in the fuse mounting. Various schemes for determining whether such a non-dropout fuse has operated have been devised. See, for example, commonly-filed, co-pending, commonly-assigned patent application, Ser. No. 740,930, filed Nov. 11, 1976, and other applications cited therein.

A dropout fuse has its internal parts so arranged that, upon operation thereof, the arcing rod or a part carried thereby (often termed a striker pin) exits at least partially from an end of the fuse. Such fuses may carry, at one end thereof, a thin metallic seal which is pierced by the striker pin and through which the striker pin partially exits after fuse operation. The protruding striker pin operates a mechanism on the fuse mounting adjacent the point of striker pin exit, to release the fuse from such mounting and to permit the fuse to rotate downwardly (i.e., drop out), thus giving a visual indication that the fuse has operated.

Clearly, a fuse designed for dropout operation could be utilized in a non-dropout mounting, wherein the protruding striker pin would not effect fuse dropout, but could give a visual indication of fuse operation without such dropout action. However, the striker pin is generally slender and not readily visible from a distance or under low light conditions. Accordingly, the use of a fuse basically intended for dropout operation in a non-dropout mounting has proven less than satisfactory insofar as a visual indication of fuse operation is given.

Non-dropout fuses, or fuses intended for dropout operation used in a non-dropout manner, may have blown fuse indicators. Such indicators have been included as a part of the fuse. Accordingly, if the fuse is discarded the blown fuse indicator is similarly discarded. This, of course, adds to the cost of the fuse.

Another problem noted with prior art fuses primarily intended for dropout operation involves the tendency of the striker pin, upon fuse operation at extremely high currents, to be driven completely from the fuse. Moreover, inasmuch as the striker pin is made of conductive metal, it may initiate short circuit or arcing conditions with respect to adjacent energized live parts which it contacts. The consequences of this problem may be especially acute where dropout fuses are used in non-dropout mountings in an enclosure.

When fuses primarily intended for dropout operation are used in enclosures, another problem may arise. Specifically, following piercing of the seal by the striker pin, gases, generated by the arc, may be vented in great quantities into the enclosure. These gases may include metallic vapors. The enclosure, of course, contains energized and grounded parts in proximity, and such gases may ultimately decrease the dielectric strength of the air between proximate live parts within the enclosure, resulting in a flashover or other damaging arcing conditions within the enclosure.

The state of the art is also such that, for a given voltage and current, manufacturers usually make fuses of two different constructions, one for indoor, non-dropout use and the other for outdoor, dropout use. This necessitates the provision of two constructionally different, but functionally similar, fuses depending upon whether dropout (outdoor) or non-dropout (indoor) use is desired, and results in increased manufacturing costs.

SUMMARY OF THE INVENTION

Accordingly, an object of the present invention is to provide an improved end fitting for a high-voltage fuse.

Another object of the present invention is the provision of an improved end fitting for a high-voltage fuse which eliminates many, if not most, or the prior art problems and shortcomings discussed above.

Yet another object of the present invention is the provision of an improved reusable end fitting for a high-voltage fuse which permits both dropout and non-dropout use of the same fuse in outdoor and indoor environments, which gives a visible indication of fuse operation, which prevents the escape from the fuse of gas which might otherwise cause flashovers within an enclosure, and which totally restrains the movement of an arcing rod and striker pin so that neither can be expelled from the fuse as a potentially harmful conductor.

With these and other objects in view, the present invention contemplates an end fitting for a fuse. The end fitting is an improvement over prior art devices and finds its greatest utility in use with high-voltage fuses. Typically, the type of high-voltage fuse with which the end fitting of the present invention is usable has a movable component contained within the fuse in a first normal position as long as a fusible element remains intact. The fusible element may cease to be intact through fuse operation (following an over-current condition) or through mishandling of the fuse which causes the fusible element to break. If the fusible element ceases to be intact for any reason, the component moves to a second position whereat it at least partially extends beyond one end of the fuse.

The improved end fitting is mountable to the fuse end and comprises a body having a bore therethrough. The first end of the body is mountable to the fuse to surround and enclose the fuse end within the bore. Mounted for movement within the bore at the second body end is a member. The member occupies a first normal location when the component is in the first normal position, and a second location when the component is in the second position. Also included are facilities for indicating that the member is in the second location. The end fitting prevents the escape from the second body end of gas vented from the fuse end, but permits some gas escape from the first body end. Facilities limit the movement of the member out of the first location and retain the member within the bore at the second location. This retention also limits the movement of the component completely out of the fuse end, and retains the component partially within the fuse and partially within the bore.

In preferred embodiments, the type of fuse with which the improved end fitting is usable has a metallic seal at the fuse end to which the end fitting is mountable, and the component is a striker pin which pierces and protrudes beyond the seal in the second position. The movable member is a rod having a headed end and a free end, the head being normally adjacent the seal in the path of the striker pin when the rod is in the normal first location. The bore preferably contains a sleeve at the second body end which conformally, slidingly engages the rod during its movement to prevent the escape from the second body end of gas which may be expelled through the pierced seal. Moreover, the head and the sleeve are so relatively dimensioned that the head cannot pass through the sleeve and seals an interior end of the sleeve within the bore when the rod is in the second location. Additionally the bore exposes only a central portion of the seal and the head is so dimensioned as to cover substantially all of the exposed central seal portion. The relative dimensions of the head and the bore are selected so that a baffle-like labyrinth between the pierced seal and the interior sleeve end is defined as the rod moves from the first to the second location. This labyrinth, in addition to the conformal engagement of the sleeve with the rod, plus the sealing of the interior sleeve end by the head, all coact to both prevent the escape from the first body of gas vented from the pierced seal and prevent both the headed rod and the striker pin from being completely expelled. The bore in the body at the first end is so dimensioned and generally conformed as to be mountable to the fuse, but the bore is not so closely fitted as to prevent the escape between the bore wall and the fuse body of some gas vented from the pierced seal. Such gas escape as may occur is directed away from proximate metallic parts and is diffuse, thus minimizing the liklihood of dielectric degradation and flashover within a confined space wherein the fuse may be mounted.

The indicating means may be an enlarged, vividly colored portion of the rod. The vividly colored enlargement is not visible when the rod is in its first location, as it is contained within and hidden by a portion of the bore at the first body end. When the rod is at its second location, the vividly colored enlargement is visually detectable for determining that the rod is in the second location and, accordingly, that the fusible element is no longer intact.

DETAILED DESCRIPTION OF THE INVENTION

Figure 1:
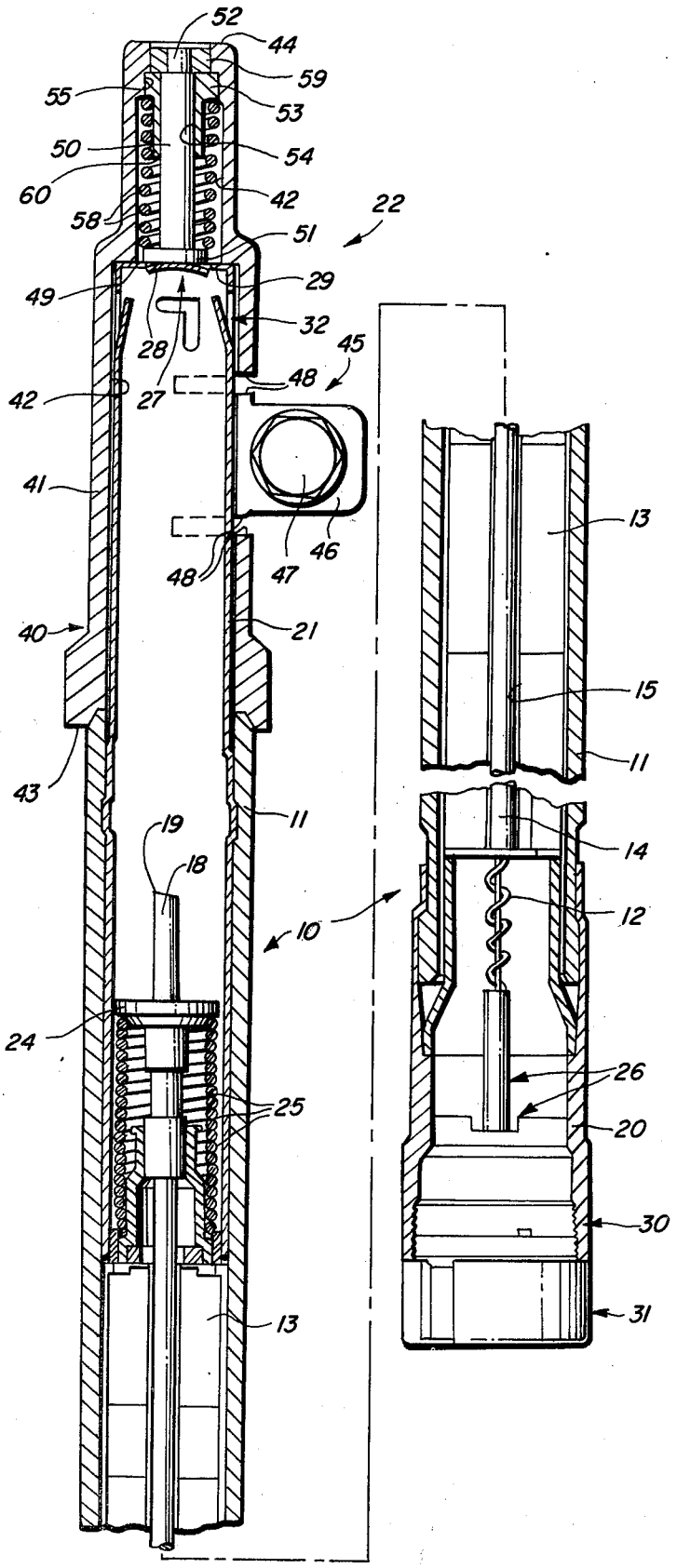
FIG. 1 is a side, partially cutaway, view of a high-voltage fuse to which is mounted the improved end fitting of the present invention.
Figure 2:
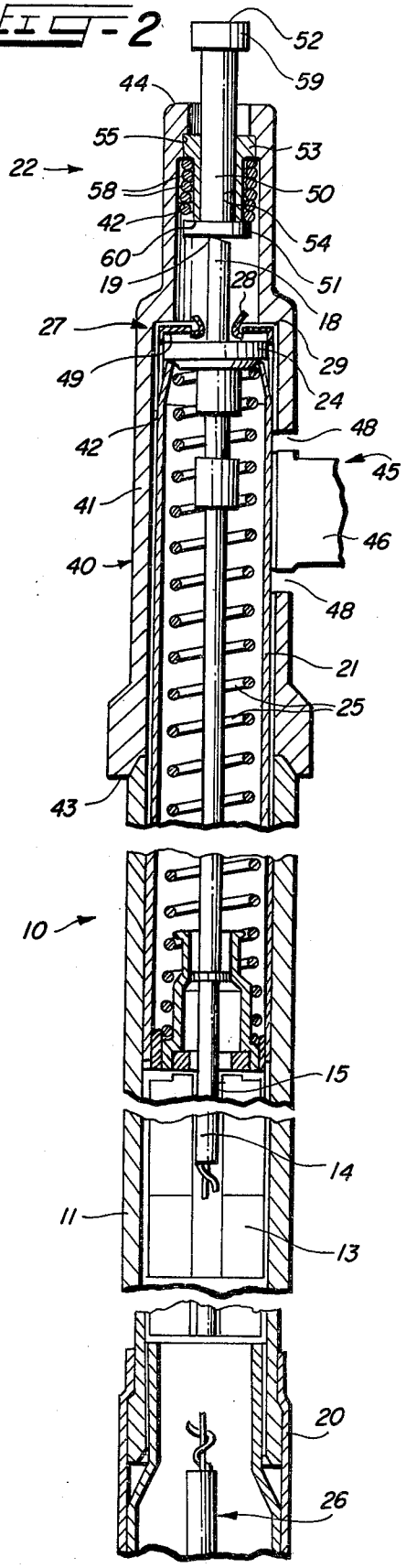
FIG. 2 is a view similar to FIG. 1 but depicting the end fitting following operation of the fuse.

Referring first to FIGS. 1 and 2, there is generally depicted a high-voltage fuse 10 with which the present invention is usable. The fuse 10 is more completely described in commonly-filed, co-pending, commonly-assigned patent application, Ser. No. 740,930, filed on Nov. 11, 1976 and other applications cited therein.

The fuse 10 includes an insulative, tubular housing 11 surrounding a fusible element 12, a body of arc-extinguishing material 13, and a metallic arcing rod 14 movable through a bore 15 in the arc-extinguishing material 13. The arcing rod 14 may carry, at one end thereof, a metallic striker pin 18 having an angular cutting tip 19 thereon. One end of the housing 11 has mounted thereto a lower ferrule 20. Telescoped within the tube at the opposite housing end is a metallic tube 21. The lower ferrule 20 is attachable to an end fitting (not shown) which is mountable in a lower fuse mounting (not shown) attached to one side of an electric circuit as is well known. The metallic tube 21 is attachable to facilities 22, according to the present invention, which are mountable in an upper fuse mounting (not shown) attached to the other side of the electric circuit.

The arcing rod 14 may include an enlarged button 24. A spring 25, normally in compression, acts between the button 24 and an end of the arc-extinguishing material body 13 to bias the arcing rod 14 away from the lower ferrule 20 and the striker pin 18 toward the end of the metallic tube 21. Such movement of the arcing rod 14 and the striker pin 18 is normally restrained by the fusible element 12 as shown in FIG. 1. Specifically, the fusible element 12 is connected at one end to the arcing rod 14 and at its other end to facilities, generally indicated by the reference numeral 26, which are electrically and mechanically connected to the lower ferrule 20. Should the fusible element 12 cease to be intact, for example due to fusing thereof following an overcurrent condition through the fuse 10, or due to mishandling of the fuse 10, this restraint on movement of the arcing rod 14 and the striker pin 18 is removed. Accordingly, the spring 25 drives the arcing rod 14 and the striker pin 18 toward the end of the metallic tube 21 as shown in FIG. 2.

The space formerly occupied by the fusible element 12, should it cease to be intact as a result in service of an over-current condition, is occupied by a high-voltage arc which terminates on the end of the arcing rod 14 and on the facilities 26. As the arcing rod 14 moves through the arc-extinguishing material 13, the arc is elongated and interacts with the surface of the arc-extinguishing material 13 within the bore 15. Such elongation, in combination with swirling, cooling, deionizing gases evolved by the interaction of the arc and the material 13, extinguishes the arc. Ultimately, the cutting tip 19 on the striker pin 18 reaches and pierces a seal 27 which normally closes the open end of the metallic tube 21 as seen in FIG. 2. In its usual configuration, the seal 27 comprises a circular piece of copper having a thinned-down central portion 28 surrounded by a relatively-thicker toroidal outer portion 29. The seal 27 is attached by conventional means, as by soldering, to the metallic tube 21. See U.S. Pat. No. 4,103,120 issued 7/25/78.

The fuse 10 may be used in dropout fashion, typically in outdoor environments. When the fuse 10 is so used, the piercing of the seal 27 by the cutting tip 19 is followed by partial exiting of the striker pin 18 beyond the end of the metallic tube 21 and the pierced seal 27. The protruding portion of the striker pin 18 operates a latching mechanism (not shown) normally retaining the fuse 10 in the upper fuse mounting to release the fuse permitting it to rotate away from the upper mounting in the lower fuse mounting to a so-called dropout position. In the dropout position, the location of the fuse 10 provides a visual indication that it has operated.

During the above-described movement of the arcing rod 14 and the striker pin 18, electrical continuity between the arcing rod 14 and the metallic tube 21 is maintained by known facilities, which may include sliding contacts which engage the arcing rod 14 in all positions thereof, and which are electrically connected to the metallic tube 21.

It should be noted that the lower ferrule 20 is attachable to a variety of end fittings designed to cooperate with a variety of lower fuse mountings to permit dropout or non-dropout mounting as desired. Moreover, it should be clear that other fuse constructions may be used with the present invention. For example, as is well known, the fusible element 12 may be accompanied by a strain wire, and a tension spring, instead of the depicted compression spring 25, may similarly be used. When the fuse 10 is used in an outdoor environment, it may include a breather assembly 30, more completely described in co-pending, commonly-assigned patent application, Ser. No. 741,024, filed on Nov. 11, 1976, now U.S. Pat. No 4,045,758, issued 8/30/77 and a rain cap assembly 31, more completely described in co-pending, commonly-assigned patent application, Ser. No. 741,023, filed on Nov. 11, 1976 now U.S. Pat. No. 4,047,142, issued 9/6/77. Moreover, the fuse 10 may include, near the seal 25, an arcing rod catcher 32, more completely described in co-pending, commonly-assigned patent application, Ser. No. 741,027, filed on Nov. 11, 1976.

Upon operation of the fuse 10, that is, upon melting of the fusible element 12, the generation of gases and vapors due to the interaction between the high-voltage arc and the arc-extinguishing material 13 creates a rather large pressure buildup within the fuse 10. Included within these gases will be a certain proportion of vaporized or volatilized metal resulting from the termination of the arc on various metallic parts, such as the arcing rod 14, the facilities 26, and the like. Accordingly, when the cutting tip 19 of the striker pin 18 pierces the seal 27 to permit the partial exiting of the striker pin 18, a portion of the gases within the fuse 10 are vented by leaking therethrough. When the fuse 10 is used in an outdoor environment, such gas venting may be tolerable in view of the rather great distances between adjacent energized live parts, and the fact that the free circulation of air available rapidly dissipates and decreases the concentration of such gases. However, should it be desired to use the fuse 10 in an indoor environment, for example, within an enclosure, the free venting of these gases which include vaporized metal could well result in a flashover, or the like, between various energized live parts within the enclosure.

Referring again to FIGS. 1 and 2, there is shown a generalized, basic version of the facilities 22 which include an improved end fitting 40 in accordance with the principles of the present invention. The end fitting 40 constitutes an upper end fitting for the fuse 10 and is intended to permit the use of the fuse 10, normally usable in dropout mountings and in outdoor environments, in indoor environments, and specifically, within an enclosure or cabinet. The end fitting 40 is intended to be mounted to the metallic tube 21 of the fuse 10. When the end fitting 40 of this invention is used with the fuse 10 in an outdoor environment, the fuse 10 is usually held in a non-dropout mounting.

The end fitting 40 includes a body 41 preferably tubular, although other configurations may clearly be chosen. The body 41 has a continuous bore 42 therethrough extending from a first end 43 of the body 41 to a second end 44. The shape and size of the bore 42 at the first end 43 of the body 41 is such that the metallic tube 21 may be conformally received therewithin.

A clamp 45 may be provided intermediate the ends 43 and 44 for firmly attaching the end fitting 40 to the metallic tube 21 of the fuse 10. The clamp 45 may comprise a pair of legs 46 formed integrally with the body 41 and extending radially away therefrom. A bolt 47 may be attached between the legs 46 to pull them together, thus applying a clamping force to a portion of the metallic tube 21 when such is inserted into the bore 42. As shown, the clamp legs 46 may in part be defined by cuts 48 formed partly through the body 41 and intersecting the bore 42. Although the depicted structure of the clamp 45 is preferred, other conventional arrangements may obviously be used.

Intermediate the ends 43 and 44, the diameter of the bore 42 is decreased from the diameter it has at the first end 43 to a smaller diameter, thus defining a shoulder 49. When the metallic tube 21 is inserted into the bore 42 from the first end 43, the end of the metallic tube 21 and the thicker outer portion 29 of the seal 25 ride against and abut the shoulder 49. In this position, only the thin central portion 28 of the seal 25 is exposed beyond the shoulder 49 in the bore 42.

Near the second end 44 of the body 41 is a rod 50 movable within the bore 42. The rod 50 may be an elongated metallic member, and preferably is headed as at 51 opposite a free end 52. The surface of the head 51 is perpendicular to the path of the movement of the arcing rod 14 and of the striker pin 18 within the fuse 10. Moreover, as shown in FIG. 1, the rod 50 has a normal first location wherein the head 51 may rest on and abut the exposed thin central portion 28 of the seal 27. Additionally, the diameter of the head 51 is only slightly smaller than the diameter of the bore 42, wherein the head 51 resides.

It is intended that the rod 50, which is movable within the bore 42, close the bore 42 during rod movement. To this end, a sleeve 53 having a bore 54 therethrough, which conformally engages the rod 50 in all positions thereof, is provided. The sleeve 53 may have the T-shaped cross section shown, wherein a space is defined between the base of the T and the wall of the bore 42. The head of the T rests against a shoulder 55 formed as a result of a slight further decrease in the diameter of the bore 42.

The length of the rod 50 is such that, in the normal first location (FIG. 1), the free end 52 rests within the bore 42 and does not protrude beyond the end of the body 41.

A coil compression spring 58 may be located in the bore 42. The spring 58 surrounds the rod 50 and acts between the lower surface of the T head of the sleeve 53 and the upper surface of the head 51, as shown. The spring 58 biases the rod 50 to its normal first location, wherein the head 51 rests against the seal 27 and the free end 52 of the rod 50 is located within the bore 42.

Attached to the free end 52 of the rod 50 by any conventional means may be an enlarged member 59. The enlarged member 59 may be a washer or the like. Preferably, the member 59 is painted a vivid color, such as red or orange. Moreover, the member 59 has a size generally equal to the diameter of the bore 42 immediately adjacent the second end 44 of the body 41 so that it is not clearly visible in the first location of the rod 50.

Referring now to FIG. 2, should the fusible element 12 of the fuse 10 cease to be intact for any reason, the spring 25 within the fuse 10 drives the arcing rod 14 and the striker pin 18 until the cutting tip 19 pierces the seal 27. At this point, the cutting tip 19 of the striker pin 18 bears against the head 51 of the rod 50. The strength of the spring 58 within the end fitting 40 is so selected that the force of the spring 25 within the fuse 10 may overcome its force. Accordingly, continued movement of the arcing rod 14 and the striker pin 18 moves the rod 50 upwardly until the head 51 abuts against an inferior end 60 of the sleeve 53. As shown, the head 51 is substantially larger than the bore 54 in the sleeve 53 and cannot pass therethrough.

Upward movement of the rod 50 continues until the head 51 abuts the end 60 and the vividly colored enlarged member 59 protrudes from, and is clearly visible beyond, the second end 44 of the body 41. The now visible vividly colored member 59 gives a clear visual indication that the fusible element 12 of the fuse 10 is no longer intact.

Should the lack of intactness of the fusible element 12 of the fuse 10 be due to an operation of the fuse 10, that is, due to an over-current condition, the same indicating function will be performed by the enlarged member 59. Moreover, as discussed earlier, fuse operation due to over-current conditions is followed by the generation of gases and vapors which may contain volatilized or vaporized metallic, conductive particles. Accordingly, when the cutting tip 19 pierces the seal 27 a quantity of these gases and vapors may be vented from the pierced seal 27. In the present invention, such venting of the gases and vapors is controlled by the end fitting 40.

Specifically, immediately following piercing of the seal 27 by the cutting tip 19, and as the head 51 moves away from the seal 27, gases vented from the pierced seal 27 fill the bore 42 between the end of the metallic tube 21 and the sleeve 53. Gas escape from the second bore end 44 is prevented, however, by two features of the structure of the end fitting 40. More specifically, the first structural feature preventing gas escape from the bore 42 includes the intimate conformal engagement between the sleeve 53 and the rod 50. As to the second feature, once the head 51 leaves the surface of the seal 27, as it is carried toward the second end 44 of the body 41 by the moving cutting tip 19, a baffle-like labyrinth or sinuous passage within the bore 42 is defined. This labyrinth or sinuous passage comprises the narrow space between the periphery of the head 51 and the wall of the bore 42, and the space above and below the head 51. The labyrinth further restricts the flow of gases and vapors therethrough, and, in combination with the sealing engagement between the rod 50 and the interior end 60 of the sleeve 53, eliminates most if not all of the gas or vapor escaping from the bore 42 at the second end 44.

In the preferred embodiment, the body portion 41 is a casting. Accordingly, the bore 42 at and near the first end 43, where the end fitting 40 engages the metallic tube 21, is made slightly larger than the diameter of the metallic tube 21. Thus, although the clamp 45 tightly holds the end fitting 40 to the metallic tube 21, a small annular passageway may be defined between the wall of the bore 42 and the outside of the metallic tube 21. Accordingly, gas and vapors being vented from the now pierced seal 27, upon finding it impossible (or nearly so) to exit the bore 42 at the second body end 44, may find a restricted path of escape between the wall of the bore 42 and the outside of the metallic tube 21. Such gas or vapor escape is minimal and also, because of the large area involved, is diffuse and has a low concentration of metallic or conductive particles which may be contained therein. This mode of gas escape from the bore 42 greatly reduces, if it does not eliminate, the chance that these gases or vapors, regardless of their content, will cause a flashover or a dielectric breakdown between energized live parts within an enclosed space where the fuse 10 may reside.

Figure 3:
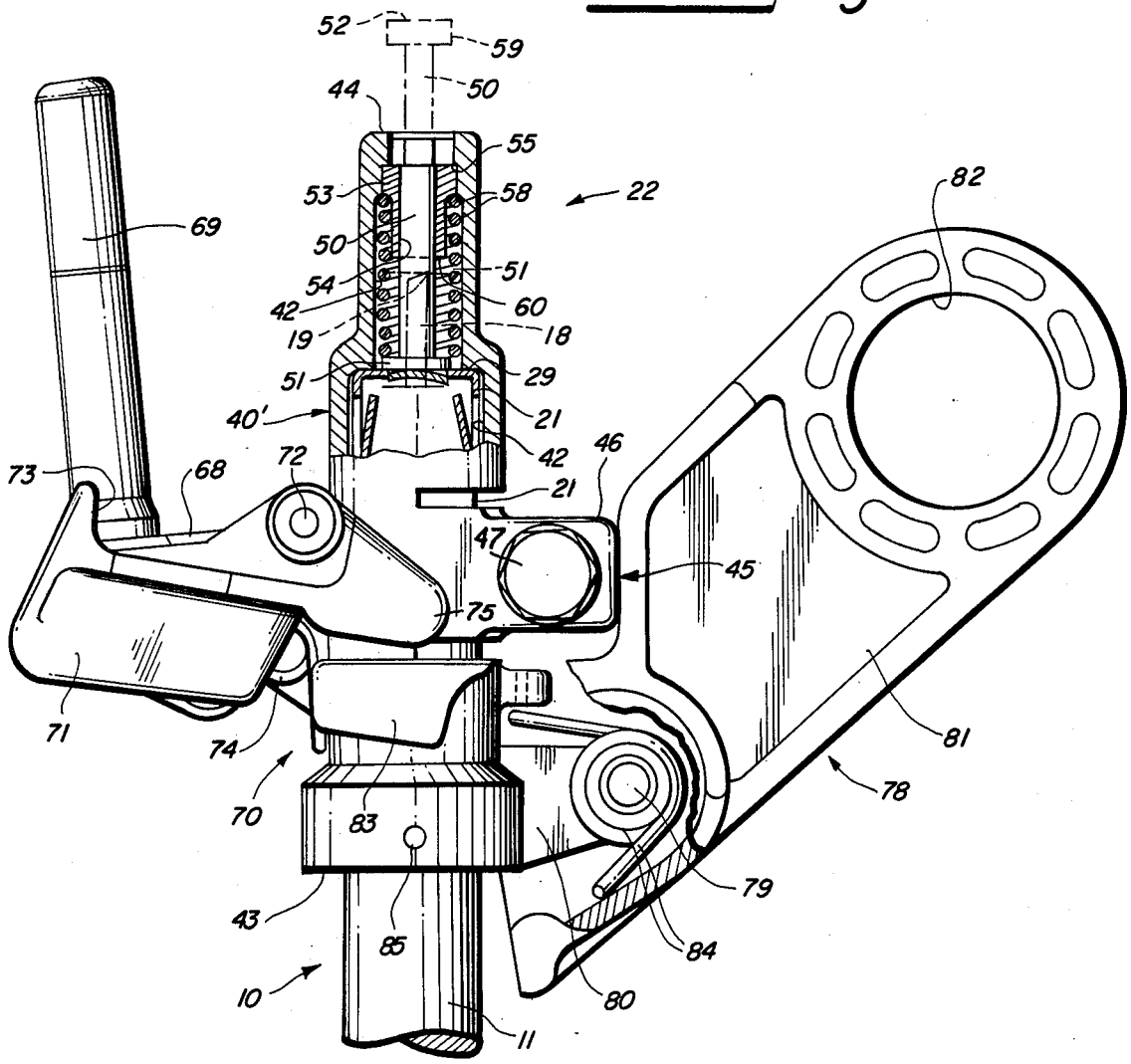
FIG. 3 is a side elevational, partially cutaway, view of a specific preferred embodiment of the end fitting depicted in FIGS. 1 and 2.

Referring now to FIG. 3, a specific preferred embodiment of an end fitting 40' according to the present invention is shown. Much of the end fitting 40' in FIG. 3 is the same as the end fitting 40 shown in FIGS. 1 and 2 and the same reference numerals are used to denote similar parts thereof.

Attached to and formed integrally with the body portion 41 is an extended leg 68. The leg preferably extends radially away from the body portion 41 diametrically opposite the legs 46 of the clamp 45. Attached to the leg 68 is an upstanding stud 69 which is generally parallel to the major axis of the fuse 10. This stud 69 is engageable by appropriate contacts (not shown). The contacts may be elements of an upper fuse mounting or of an interrupter and disengagement of the stud 69 therefrom may effect the operation of the interrupter, as more completely described in commonly-assigned, copending patent application, Ser. No. 660,872, filed Feb. 24, 1976.

In order to maintain the stud 69 in its normal engagement with the contacts, there is provided a latching arrangement 70. The latching arrangement includes one or more latch members 71, pivotally mounted as at 72 to the leg 68. The latch members 71 include hook-like projections 73 for engaging complementary surfaces on the upper fuse mounting (not shown), or on the above-mentioned interrupter (not shown), for normally maintaining the stud 69 in engagement with the contacts (not shown). A spring 74, mounted between the end fitting 40 and the latch members 71, holds the hook-like projections 73 in a normal upward position, and one or more rearward extensions 75 in a downward position, both with respect to the pivotal mounting 72. Also included is a pull ring assembly 78 pivotally mounted, as at 79, to a leg 80 integral with the end fitting 40 near the first end 43 thereof. The pull ring assembly 78 includes a projecting portion 81, having a hole 82 therethrough, which is engageable by the hook end of a hookstick or the like. The projecting portion 81 is on one side of the pivotal mounting 79, and one or more arms 83, integral with the projecting portion 81, are on the other side of such pivotal mounting 79. As viewed in FIG. 3, a force properly applied to the projecting portion 81 of the pull ring assembly 78 rotates the pull ring assembly 78 on the pivotal mounting 79 to move the arms 83 upwardly about the pivotal mounting 79. Such upward movement of the arms 83 moves the rearward extensions 75 of the latch member 71 upwardly, thus lowering the hook-like projections 73. Lowering of the hook-like projections 73 releases such projections from the complementary surfaces (not shown) normally engaged thereby to release the fuse 10 for movement away from the interrupter, or other upper fuse mounting, the contacts of which normally engage the stud 69. A spring 84 surrounds the pivotal mounting 79 and biases the pull ring assembly 78 so that the projecting portion 81 is normally located upwardly, while the arms 83 are normally located downwardly. Preferably, both the pull ring assembly 78 and the latch member 71 are made of an insulative composition, such as a polycarbonate resin.

The fuse 10 will also be attached to a fuse mounting (not shown) at a lower end thereof. The lower fuse mounting and whatever lower end fitting is chosen to be mounted to the ferrule 20 may permit rotation of the fuse 10 about the lower mounting and movement of the stud 69 away from the contacts of the interrupter or other upper fuse mounting following operating of the latching arrangement 70. Since the direction of rotation of the fuse 10 is generally directly away from the interrupter, the lower mounting and lower end fitting must be properly oriented relative to the end fitting 40', including the stud 69 and the latching arrangement 70.

To this end, the end fitting 40' may include a locating pin 85 extending into the bore 42 near the first body end 43. This locating pin 85 fits into a slot (not shown) formed in the fuse housing 11 to permit mounting of the end fitting 40' to the fuse 10 in only one orientation thereof. The lower end fitting (not shown) may have a similar locating pin thereon which will fit into a similar slot in the lower end of the fuse body 11 near the lower ferrule 20.

Although certain embodiments of the present invention are described and depicted herein, this invention is not limited thereto, but is capable of modification and rearrangement. The fuse 10 may have a construction other than that shown as long as it contains a component which moves as a function of the intactness of a fusible element. Whether that component is an arcing rod, a striker pin or a similar structure is unimportant, provided it at least partially protrudes from the fuse after the fusible element ceases to be intact. Moreover, although the end fittings 40 and 40' are especially useful in adapting a dropout fuse to non-dropout use, such is not necessary—the fuse 10 may be a dropout or a non-dropout fuse. Also, the end fittings may or may not have latching arrangements 78 thereon, and if they do, such arrangements need not take the specific form shown.

I claim:

1. An improved end fitting for use with a fuse of the type having a movable component in a first normal position or in a second position as a function of the intactness or lack thereof of a fusible element within the fuse; the component in the second position at least partially exiting beyond one end of the fuse; the end fitting being mountable to the one fuse end; wherein the improved end fitting comprises:

a body having a bore therethrough open at both ends, the first end of the body being mountable to the fuse to surround and enclose the one fuse end;

a member mounted for movement in the bore at the second body end between a first normal location, when the component is in the first normal position, and a second location when the component is in the second position;

resilient means for biasing the member to the first location; and means for indicating when the member is in the second location.

2. The improved end fitting of claim 1 for use with a high-voltage fuse of the type also having a seal at the one fuse end, the component being a striker pin which in the first normal position is within the fuse and covered by the seal, and in the second position pierces through and exits from the seal, wherein the member comprises:

a rod having a headed end and a free end, movement of the rod being longitudinal along the bore, the head being adjacent the seal in the path of striker pin movement when the rod is in the first normal location.

3. The improved end fitting of claim 2, wherein the indicating means comprises:

and indicator on the free end of the rod, the indicator being visually detectable only when the rod is in the second location.

4. The improved end fitting of claim 3, wherein the indicator comprises:

a vividly colored enlargement on the free end of the rod, the enlargement being within the bore at the second body end and not visible when the rod is in the first normal location and being outside the bore and visible when the rod is in the second location.

5. The improved end fitting of claim 4 wherein the body further comprises:

a sleeve in the bore at the second body end for conformally, slidingly engaging the rod during movement thereof to prevent the escape from the second body end of gas vented from the pierced seal; and the head and the sleeve being so relatively dimensioned that the head cannot pass therethrough, the head sealing an interior end of the sleeve within the bore when the rod is in the second location.

6. The improved end fitting of claim 5, wherein the size of the bore intermediate the first and second body ends is such that the body partially covers the seal to expose only a central portion thereof;

the head covers substantially all of the exposed central seal portion when the rod is in the first location; and the relative dimensions of the head and the bore between the seal and the second body end are such as to define a baffle-like labyrinth between the pierced seal and the interior sleeve end as the rod moves from the first to the second location.

7. The improved end fitting of claim 6, wherein the resilient biasing means comprises:

a spring within the bore at the second body end, the spring acting between the sleeve and the head.

8. The improved end fitting of claim 7 wherein the spring comprises a coil compression spring surrounding the rod.

9. The improved end fitting of claim 8 wherein the bore at the first body end is so dimensioned as to be conformally mountable to the fuse and to permit gas vented from the pierced seal to escape from the first body end.

10. The improved end fitting of claim 9 which further comprises:

means for removably mounting the end fitting to the fuse, the end fitting being removable from the fuse when the fusible element ceases to be intact, and for removably mounting the end fitting to another fuse in which the fusible element is intact.

11. The improved end fitting of claim 10 wherein the fuse is mountable in a fuse mounting having a latch surface, the end fitting further comprising selectively operable latching means for selectively engaging the latch surface to maintain the end fitting and the fuse in a predetermined orientation relative to the fuse mounting or to permit movement of the end fitting and the fuse out of the predetermined orientation.

12. The improved end fitting of claim 11 wherein the fuse mounting includes an electrical contact, the end fitting further comprising a stud carried by the body and selectively engageable with the contact.

13. The improved end fitting of claim 1 which further comprises first means for preventing the escape from the second body end of gas vented from the one fuse end.

14. The improved end fitting of claim 13 which further comprises second means for permitting the escape from the first body end of gas vented from the one fuse end.

15. The improved end fitting of claim 14 which further comprises third means for limiting movement of the member to retain the member partially in the bore at the second location and for preventing movement of the component out of the one fuse end to retain the component partially in the fuse and partially in the bore.

16. The improved end fitting of claim 15 wherein the member and the first, second and third means comprise a rod having a headed end and a free end, movement of the rod being longitudinal along the bore, the head being normally adjacent the fuse end in the path of component movement;

a sleeve in the bore at the second body end for conformally, slidingly engaging the rod during movement thereof, the head and the sleeve being so relatively dimensioned that the head cannot pass therethrough but seals against an interior end thereof when the rod is in the second location;

the size of the bore intermediate the first and second body ends being such that the body partially covers the one fuse end to expose only a central portion thereof;

the head covering substantially all of the exposed central fuse end portion when the rod is in the first location;

the relative size of the head and the bore intermediate the one fuse end and the second body end being such as to define a baffle-like labyrinth between the one fuse end and the interior sleeve end as the rod moves from the first to the second location; and the bore being so dimensioned at the first body end as to be conformally mountable to the fuse and to permit gas flow between the one fuse end and the second body end.

17. The improved end fitting of claim 16 which further comprises means for biasing the rod to the first location.

18. The improved end fitting of claim 17 wherein the biasing means comprises a coil compression spring surrounding the rod and acting between the sleeve and the head.

19. The improved end fitting of claim 18 wherein the indicating means comprises a vividly colored enlargement on the free rod end, the enlargement being within the bore at the second body end and not visible when the rod is in the first normal location, and being outside the second body end and visually detectable when the rod is in the second location.

20. The improved end fitting of claim 1 which further comprises means for limiting movement of the member to retain the member partially in the bore at the second location and for preventing movement of the component out of the one fuse end to retain the component partially in the fuse and partially in the bore.

21. An improved end fitting for a high-voltage fuse of the type having a movable component which is in a first or a second position as a function of the intactness or lack thereof of a fusible element and a movable striker pin which pierces and exits from a seal at one end of the fuse as a result of the component occupying the second position; the end fitting being removably attachable to the one fuse end; wherein the improved end fitting comprises:

a tubular body open at both ends, a first end of the body being mountable to the fuse end to surround and enclose the seal;

a headed elongated rod movably mounted in, and intimately engaged by, the second end of the body; the head of the rod normally resting against the seal in the path of movement of the striker pin to normally locate the free end of the rod within the body, the exiting of the striker pin moving the rod to locate the free end thereof outside of the body;

means for biasing the head of the rod against the seal; and means on the free end of the rod for giving a readily observable visual indication of the lack of intactness of the fusible element when the free rod end is located outside of the body.

22. An improved, reusable end fitting selectively mountable on an outdoor fuse to render the fuse usable in an enclosure or indoors, the fuse being of the type having a movable component in a first normal position or in a second position as a function of the intactness or lack thereof of a fusible element within the fuse; the component in the second position at least partially exiting beyond one end of the fuse; the end fitting being mountable to the one fuse end; wherein the improved end fitting comprises;

a body having a bore therethrough open at both ends, the first end of the body being mountable to the fuse to surround and enclose the one fuse end;

a member mounted for movement in the bore at the second body end between a first normal location, when the component is in the first normal position, and a second location when the component is in the second position; and means for indicating when the member is in the second location.

23. An improved end fitting according to claim 22, which further comprises;

means for selectively mounting the end fitting on the fuse and for permitting selective demounting of the end fitting therefrom; and resilient means for biasing the member to the first location, the end fitting being removable from the fuse after the lack of intactness of the fusible element thereof and being reusable with another fuse.

* * * * *